US006378742B1

(12) United States Patent
Rohr et al.

(10) Patent No.: US 6,378,742 B1
(45) Date of Patent: Apr. 30, 2002

(54) FLUID DISPENSING CLOSURE

(75) Inventors: Robert Rohr, LaOtto; Thomas Kasting, Fort Wayne; Jeffrey L. Beaver, Indianapolis, all of IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 09/686,769

(22) Filed: Oct. 10, 2000

(51) Int. Cl.[7] ..... B65D 37/00

(52) U.S. Cl. ..... 222/494; 222/482; 222/491; 222/496

(58) Field of Search ..... 222/212, 213, 222/482, 491, 494–496

(56) References Cited

U.S. PATENT DOCUMENTS

| | | | | | |
|---|---|---|---|---|---|
| 996,127 | A | | 6/1911 | Patnaude | |
| 2,401,124 | A | | 5/1946 | Walker et al. | |
| 2,401,674 | A | | 6/1946 | Vizay | |
| 2,574,338 | A | | 11/1951 | Lewis | |
| 2,986,310 | A | | 5/1961 | Spaulding | |
| 3,125,135 | A | | 3/1964 | Boyer et al. | |
| 3,318,346 | A | | 5/1967 | Maltner | |
| 3,459,245 | A | | 8/1969 | Schreiber et al. | |
| 3,540,402 | A | | 11/1970 | Kocher | |
| 3,635,380 | A | | 1/1972 | Fitzgerald | |
| 4,147,306 | A | * | 4/1979 | Bennett | 222/212 |
| 4,164,307 | A | | 8/1979 | Imamura et al. | |
| 4,272,019 | A | | 6/1981 | Halaby, Jr. | |
| 4,281,779 | A | | 8/1981 | Shepard | |
| 4,372,467 | A | | 2/1983 | Pritchitt | |
| 4,393,894 | A | | 7/1983 | Mol et al. | |
| 4,420,100 | A | * | 12/1983 | Mueller | 222/212 |
| 4,513,891 | A | * | 4/1985 | Hain et al. | 222/213 |
| 4,874,023 | A | | 10/1989 | Ulm | |
| 4,903,742 | A | | 2/1990 | Gagnon | |
| 4,924,921 | A | | 5/1990 | Simmel et al. | |
| 5,042,698 | A | | 8/1991 | Fessell | |
| 5,114,047 | A | | 5/1992 | Baron et al. | 222/129.1 |
| 5,154,325 | A | * | 10/1992 | Ryder et al. | 222/212 |
| 5,240,033 | A | | 8/1993 | Erdmann et al. | |
| 5,255,826 | A | * | 10/1993 | Ranaletta et al. | 222/212 |
| 5,275,309 | A | | 1/1994 | Baron et al. | 222/129.1 |
| 5,366,115 | A | | 11/1994 | Kersten | |
| 5,379,813 | A | | 1/1995 | Ing | |
| 5,431,205 | A | | 7/1995 | Gebhard | |
| 5,477,994 | A | * | 12/1995 | Feer et al. | 222/484 |
| 5,518,147 | A | * | 5/1996 | Peterson et al. | 222/212 |
| 5,617,906 | A | | 4/1997 | Braatz et al. | |
| 5,680,970 | A | | 10/1997 | Smih et al. | |
| 5,755,269 | A | | 5/1998 | Venooker | |
| 5,873,478 | A | * | 2/1999 | Sullivan et al. | 222/482 |

* cited by examiner

*Primary Examiner*—J. Casimer Jacyna
(74) *Attorney, Agent, or Firm*—McDonald, Hopkins, Burke & Haber Co., L.P.A.

(57) ABSTRACT

A fluid dispensing closure which incorporates a dispensing valve to control fluid flow through the closure and a vent passageway to vent air into the container as necessary. The closure includes a dispensing spout capable of mating engagement with a receiving container. The dispenser spout has a fluid passageway with a resilient valve made from an elastomeric material seated therein. The vent passageway formed in the closure is selectively sealed by a grommet depending upon the vacuum created within the container as the fluid is being dispensed from the container. A removable overcap sealingly covers the dispensing spout to capture any fluid leakage.

16 Claims, 4 Drawing Sheets

FLUID DISPENSING CLOSURE

BACKGROUND OF THE INVENTION

I. Field of the Invention

This invention relates to a fluid dispensing closure for selectively dispensing fluids such as juices into a desired container and, in particular, to a dispenser matingly engageable with a receiving container and including, in combination, a resilient spring-biased dispensing valve and a vent valve.

II. Description of the Prior Art

A variety of closures have been developed for selective control of fluid flow from a container. The most common closure incorporates a valve which may be rotated or otherwise manually opened and closed to dispense fluid from the container. The dispensing closure is typically situated near the bottom of the container allowing gravity to force fluid through the closure.

Commercial beverage dispensers incorporate mechanical dispensing means associated with the housing. Examples include commercial milk and juice dispensers that have external dispensing systems. Here, the juice or milk is transported in bulk containers. The mechanical dispensing systems attach to the bulk containers via the closure. The closures for the bulk containers must be capable of preventing fluid leakage during transport while also preventing contamination of the contents and dispensing closure.

Further, it is important that the fluid flow from the container is uninterrupted. This is achieved by preventing a vacuum buildup within the container as the fluid is being dispensed by using a venting system that allows air to replace the dispensed liquid. Prior art containers typically incorporate a vent hole at the top of the container to prevent the excess vacuum build up within the container. Although this is a workable solution, it presents problems for the container manufacturers in that two separate openings must be made in the container. It also creates problems for the container users because the second opening, typically a simple vent hole, is difficult to seal while the container is being filled, stored and transported.

The object of the invention is to address these problems by providing a closure that will cooperate with the dispensing machine to facilitate on demand pouring of fluids such as juice or milk.

SUMMARY OF THE PRESENT INVENTION

The present invention overcomes the disadvantages of the prior known dispensers by providing a dispensing closure which incorporates a resilient spring-biased dispensing valve and vent valve within the confines of the closure.

The fluid dispensing closure of the present invention includes a substantially cylindrical housing adapted to be threadably attached to the container. A cylindrical dispensing spout, in fluid communication with the container, extends from the housing. A valving member is disposed within the dispenser spout to control fluid flow therethrough. In a preferred embodiment the valving member comprises a resilient elastomeric valve element that is seated within the dispenser spout to control fluid flow. This one-piece valve element replaces the more standard valve mechanisms that usually comprise multiple components, for example, a ball and spring configuration, or a plunger and washer assembly. Hence, the instant invention is less expensive and simpler to manufacture.

The dispenser spout accommodates a venting assembly, which includes a vent passageway in communication with a vent opening. A vent grommet is captured within the vent passageway for selectively closing the vent opening in response to the accumulated vacuum pressure created as the liquid is dispensed from the container. This action effectively vents the dispensing closure.

The dispenser includes means for receiving a removable overcap. The overcap covers the dispensing spout to capture and retain any potential fluid leakage. The overcap may be extended to cover the vent opening in addition to the dispensing spout. The overcap includes a rim bead adapted to engage an annular groove extending around the spout and vent. The overcap can be removed and reattached by simply flexing the overcap.

The dispensing spout is provided with an O-ring seal to facilitate sealing engagement with a receiving container. Upon insertion of the spout into the receiving container, the resilient spring-biased valve is displaced from its valve seat allowing fluid to flow through the spout. Gravity will cause the vent grommet to close off the vent opening, thereby ensuring that fluid flows through the spout and not the vent.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
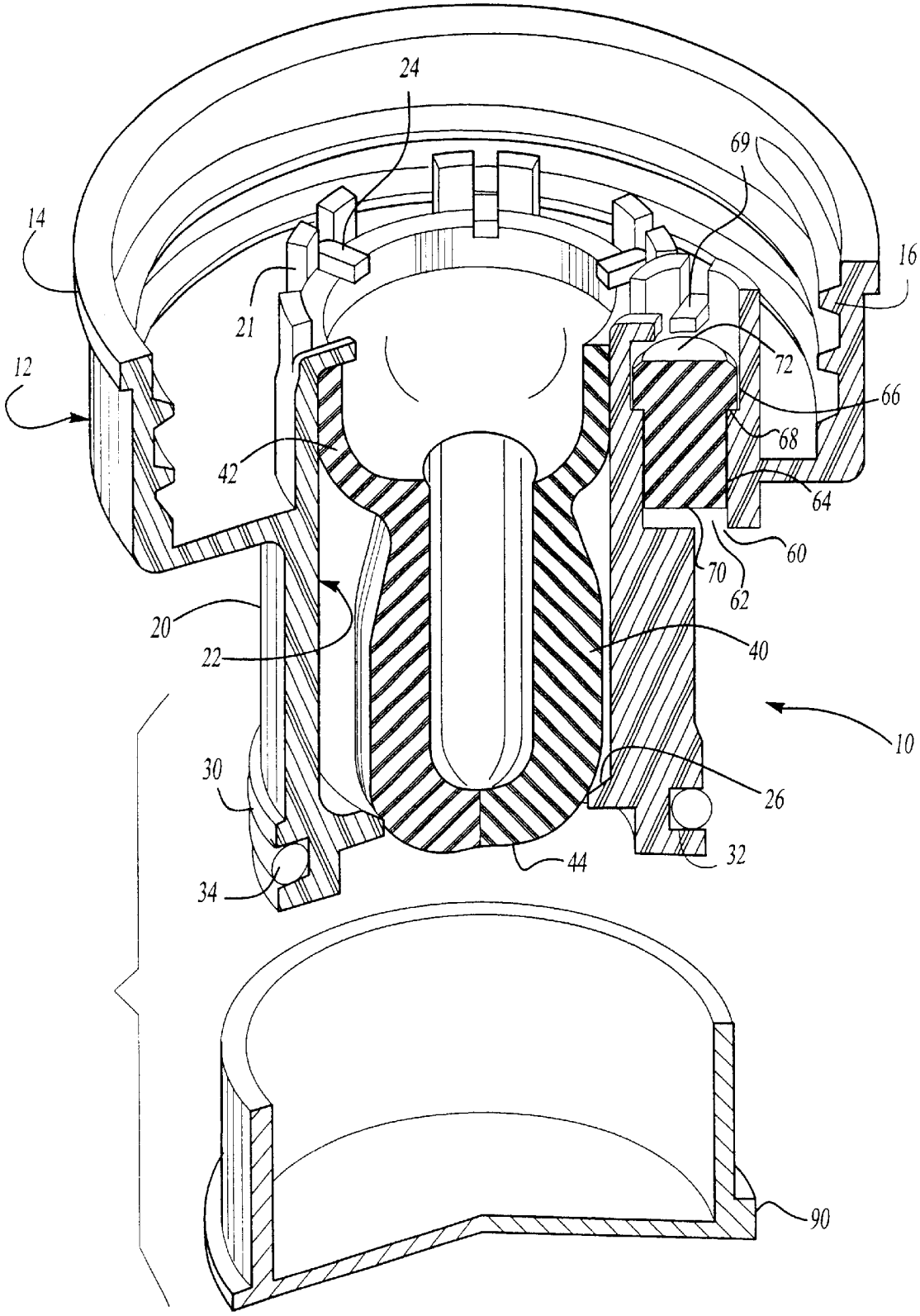
FIG. 1 is an exploded, perspective, cross-sectional view of the dispensing closure and the overcap.

FIG. 1 illustrates a preferred embodiment of the invention in which a fluid dispensing closure 10 is shown. The closure 10 attaches at one end to a bulk fluid container 100 or, for example, milk or juice, and at the other end to a dispensing system. The closure 10 prevents fluid from leaking during the transportation and storage of the bulk container 100. Further, the closure 10 permits the selective dispensing of fluid from the container 100 to the dispensing system without an interruption in the fluid flow from the container 100.

Referring to FIG. 1, the closure 10 comprises a housing 12, a resilient valve assembly 40, and an overcap 90. The housing 12 is adapted to be secured to the bulk container 100. The housing 12 has an upper attachment portion 14 and a downward-extending dispensing spout 20. In a preferred embodiment, the upper attachment portion 12 incorporates mating threads 16 for the threaded engagement with the bulk container 100.

The downward-extending dispensing spout 20 has a tubular configuration, and is smaller in diameter than the housing 12. The dispensing spout 20 is configured to matingly engage a dispensing system (not shown) such as a pump. The bottom portion of the dispensing spout 20 has a plurality of ridges 30 and grooves 32 for the secure attachment with the dispensing system. To effect a more secure, fluid-tight seal with the dispensing system, an O-ring 34 is inserted within the groove 32.

Extending upwards from the dispensing spout 20 and into the upper attachment portion 14 are a plurality of pillars 21. The pillars 21 are spaced apart in an annular configuration around the upper circumference of the dispensing spout 20. The pillars 21 and the dispensing spout 20 form an inner fluid channel 22 extending through the closure 10. Preferably, the pillars are molded integrally with the housing 12.

Figure 5:
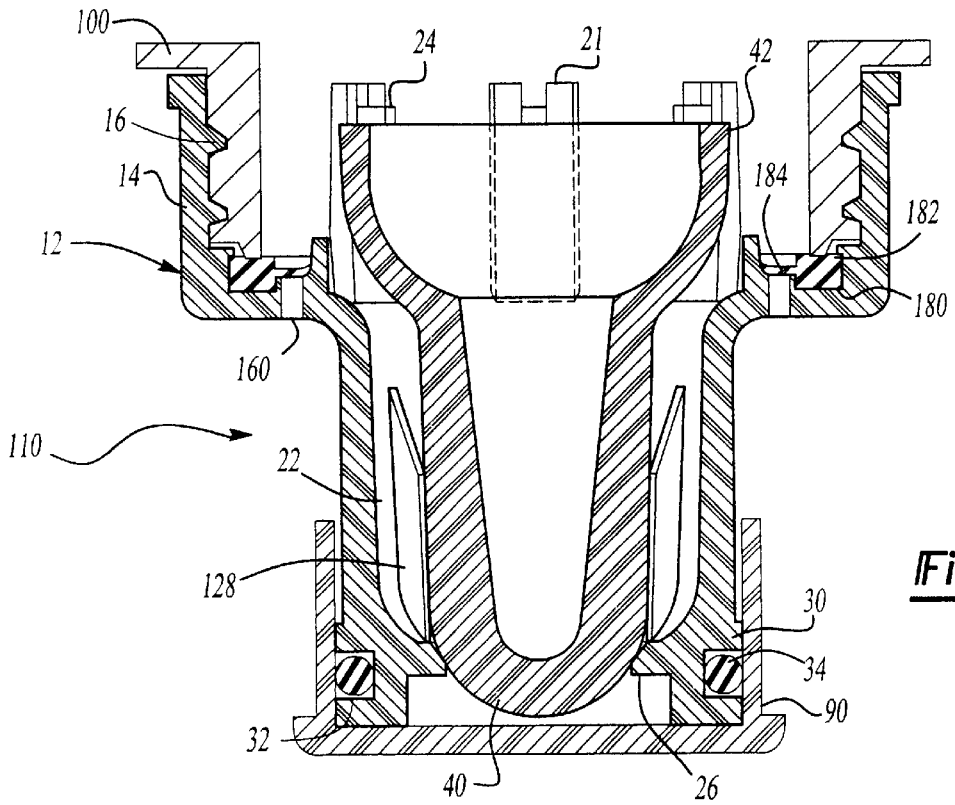
FIG. 5 is a cross-sectional view of the alternate embodiment illustrated in FIG. 2.
Figure 6:
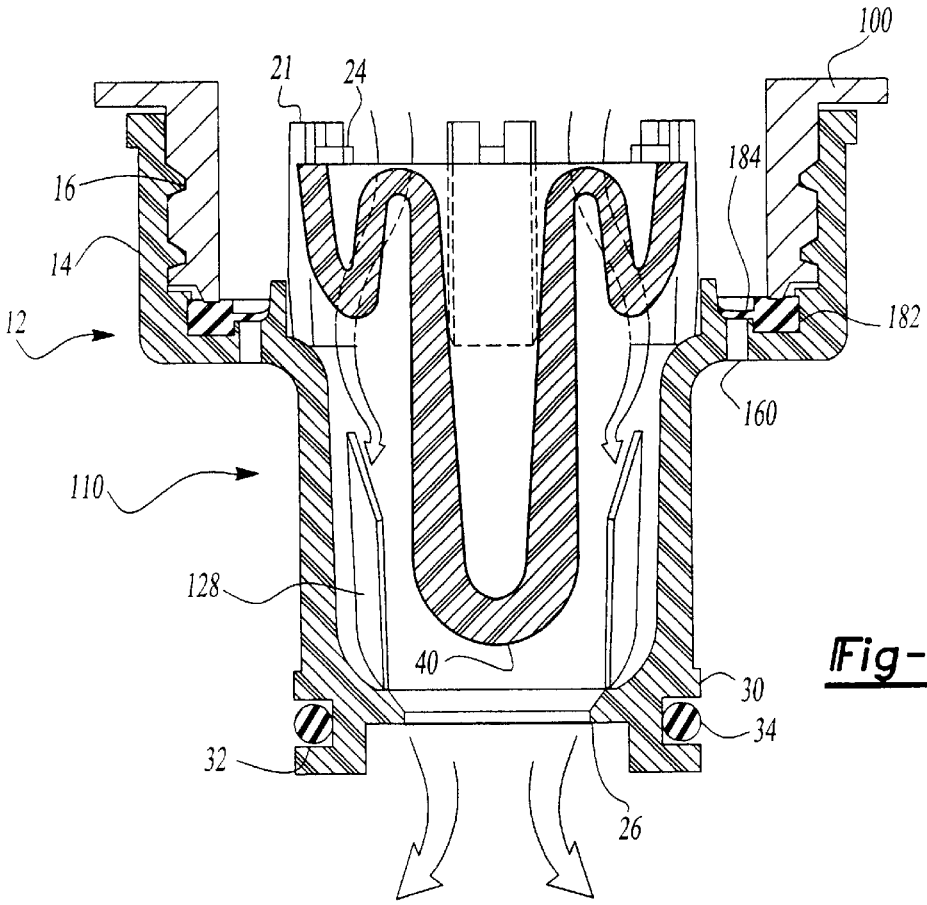
FIG. 6 is a cross-sectional view of the alternate embodiment illustrated in FIG. 2, having the resilient check valve in the open position.

The inner fluid channel 22 houses a resilient check valve 40. A plurality of retention tabs 24 are situated at the top ends of the pillars 21, and serve to retain the check valve 40 within the fluid channel 22. A valve seat 26 is formed at the bottom portion of the dispensing spout 20 by an annular, inwardly protruding ridge on the inside surface of the fluid channel 22. Preferably, as shown in FIGS. 5 and 6, guide ribs 128 are incorporated along the inner surface of the dispensing spout 20. These guide ribs 128 serve to secure and orient the check valve 40 within the fluid channel 22.

The check valve 40, housed within the fluid channel 22, comprises an elongated stopper or plug made from a resilient elastomeric material. Although not required by the invention, the resilient check valve 40 is shown having a larger diameter top portion 42 and a rounded bottom portion 44. The resilient check valve 40 is sized so that the rounded bottom portion 44 seats within the valve seat 26, while the top portion 42 is anchored against the retention tabs 24. Although illustrated as a hollow stopper, the resilient check valve 40 may be a solid plug or some other configuration, provided the check valve will seat appropriately within the valve seat and return to its original position after being deformed to the open position.

Also disposed within the housing 12 is a vent 60, which allows air to replace the dispensed fluid, thereby, preventing an interruption in the flow of fluid through the closure. The vent 60 opens into a vent passageway 62 that is molded directly within the housing 12 of closure 10 adjacent to the fluid dispensing spout 20. The vent passageway 62 is shaped so that the bottom portion 64 is narrower in diameter that the top portion 66. The junction between the top portion 66 and the bottom portion 64 of the passageway 62 forms a shoulder 68. A vent-retaining tab 69 is located at the top of the vent passageway 62.

A vent grommet 70, shaped to fit within the vent passageway 62 has a larger diameter head potion 72. The vent grommet 70 rests within the vent passageway 62 with its head portion 72 seated on the shoulder 68. This effectively seals off the vent passageway 62. The vent grommet 70 may travel within the vent passageway 62, between a fully open position where the vent grommet 70 abuts against the vent retaining tab 69, and a closed position where the vent grommet 70 is seated against the shoulder 68.

Figure 3:
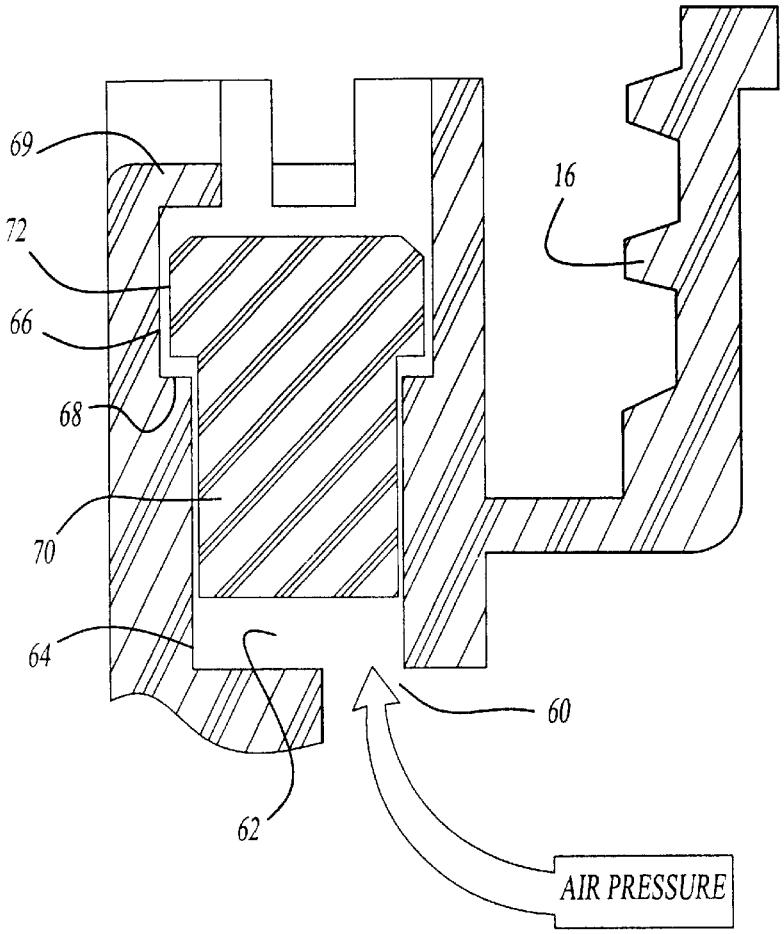
FIG. 3 is an enlarged cross-sectional view of the vent opening and vent grommet.

The weight of the vent grommet 70 serves to close the vent passageway 62 by sealing the top of the passageway 62 at the shoulder 68. However, as fluid is dispensed from the container 100, a vacuum builds within the housing 12 until the force is sufficient to lift the vent grommet 70 from the shoulder 68. This unseating of the vent grommet 70, as illustrated by FIG. 3, causes air to vent through the closure 10, thereby allowing fluid to dispense smoothly from the container 100.

As shown in FIGS. 1 and 5, an overcap 90 may be removably attached to the closure 10. The overcap 90 serves to keep contaminants off the dispensing spout 20 prior to use. Additionally, because the overcap 90 may be extended upwards to encircles both the dispensing spout 20 and the vent 60, any fluid leakage from either passageway will be captured and retained within the overcap 90.

Figure 2:
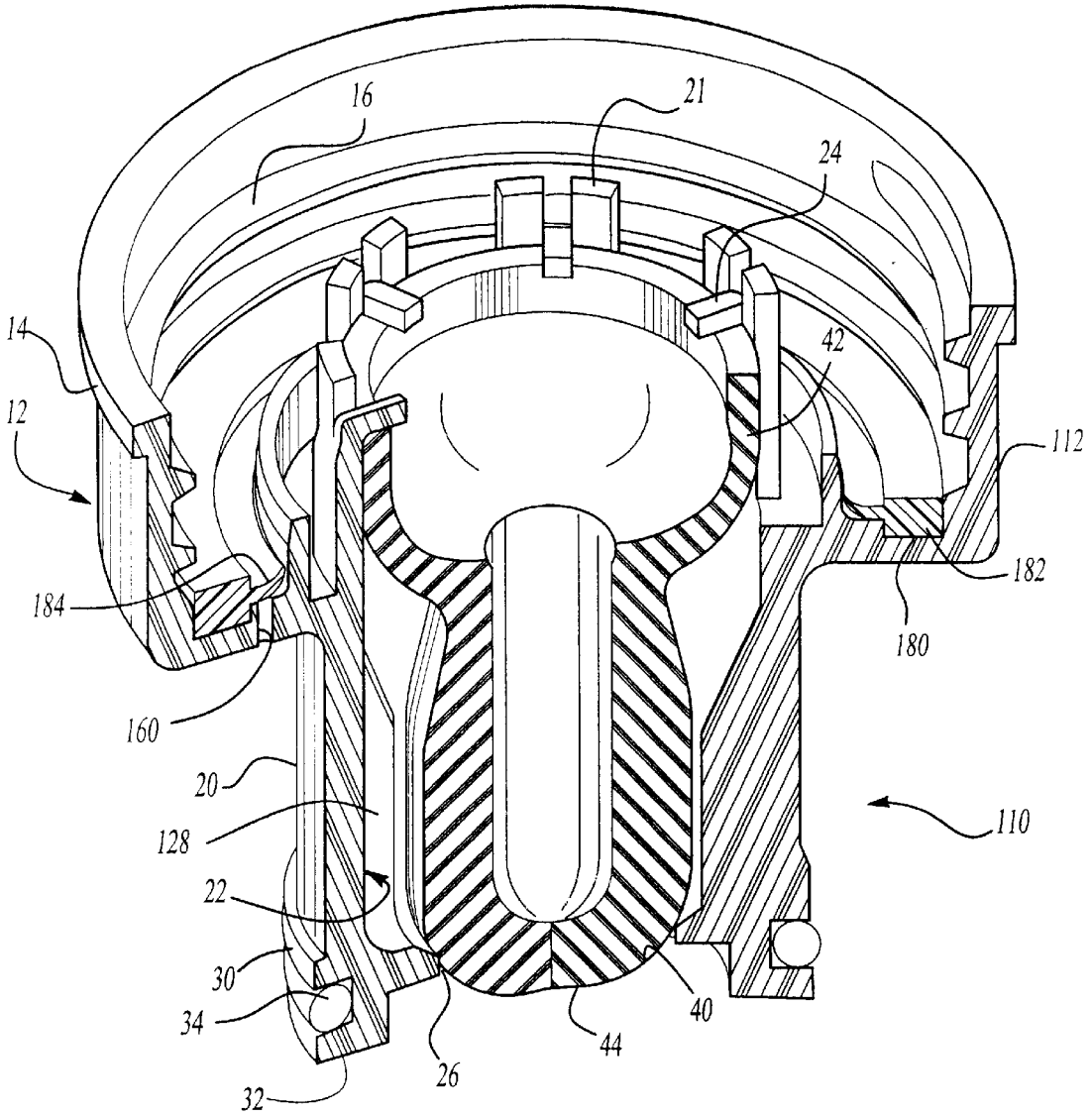
FIG. 2 is a perspective, cross-sectional view of an alternate embodiment of the fluid dispensing closure.

In an alternate embodiment, as illustrated in FIG. 2, the vent and vent passageway are replaced by one or more vent openings 160 that extends through the housing 112. The vent openings 160 emerges through the housing 112 adjacent an annular channel 180 for receiving a sealing gasket 182. Preferably, the sealing gasket has an inwardly-extending annular flange 184 that covers the vent openings 160. It would be obvious to one skilled in the art that a separate gasket may be used to seal the vent openings 160.

Figure 4:
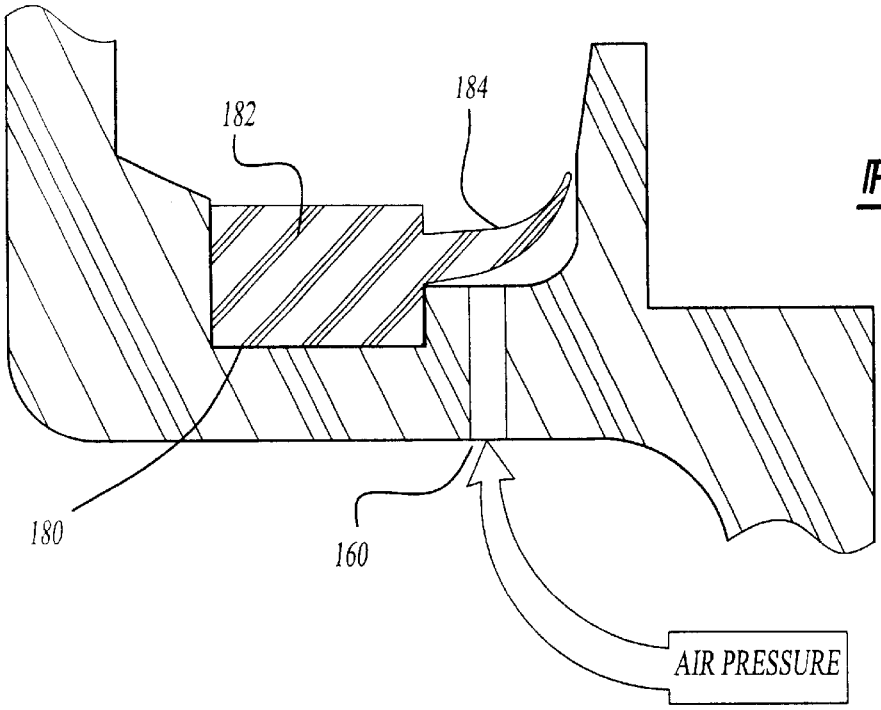
FIG. 4 is an enlarged cross-sectional view of the alternate vent opening configuration.

In this embodiment, as best illustrated by FIG. 4, the weight of the gasket and the fluid within the container 100 seal off the vent opening 160. As fluid is dispensed from the container 100, a vacuum builds within the housing 112 until the force is sufficient to lift the gasket flange 184 to open the vent opening 160, thereby causing air to vent through the closure 110.

The closure 10, 110 is designed to selectively dispense fluid from a container 100 into a dispensing system. The closure 10, 110 is secured to the container 100 once the container 100 is filled. During transport and storage, the overcap 90 is maintained on the closure 10, and the closure 10, 110 is in the closed position as shown in FIG. 5. Prior to use, the overcap 90 is removed and the dispensing spout 20 is inserted into the dispensing system. The dispensing spout 20 sealingly engages the dispensing system, which includes means (not shown) for pushing the resilient check valve 40 away from the valve seat 26. This places the closure 10, 110 in the open position, as shown in FIG. 6, and allows fluid within the container 100 to flow through the closure 10, 110 and around the resilient check valve 40. The dispensing of fluid from the container 100 is now controlled by the dispensing system. Once the container 100 has been emptied, the container 100 and the closure 10, 110 are removed from the dispensing system. This allows the resilient check valve 40 to expand and return to its original shape, thereby seating itself against the valve seat 26. This action closes the fluid passageway 22 through the closure 10, and prevents any residual fluid from escaping through the closure 10, 110 as the empty container 100 is being replaced with full ones.

The foregoing detailed description has been given for clarity only and no unnecessary limitations should be understood therefrom as some modifications will be obvious to those skilled in the art without departing from the scope and spirit of the appended claims.

What is claimed is:

1. A dispensing closure for selectively dispensing fluid from a container into a receiving system, the dispensing closure comprising:

a housing having an inner threaded surface for threaded attachment to the container, and an outer surface;

a dispensing spout extending downwards from the housing and having an upper end and a dispensing end;

a plurality of pillars, integrally molded with, and extending upwards from, the upper end of the dispensing spout;

a series of tabs extending inwardly from the pillars;

a valve assembly for selectively dispensing fluid through the spout, the valve assembly being contained within the dispensing spout;

a vent opening contained within the housing at a location displaced from the spout.

2. The dispensing closure as described in claim 1, wherein the dispensing end of the dispensing spout has an annular, inwardly-extending flange thereby forming a circular aperture, and wherein the valve assembly contained within the dispensing spout, comprises a resilient, elastomeric stopper having a top end and a sealing end, the sealing end being sized to seat sealingly within the circular aperture of the dispensing spout.

3. The dispensing closure as described in claim 2, wherein the elastomeric stopper is anchored between the tabs and the circular aperture.

4. The dispensing closure as described in claim 3, wherein the vent opening comprises an opening in the housing forming a passageway to the inside of the closure, and a grommet anchored within the passageway for selectively closing the vent opening.

5. The dispensing closure as described in claim 4, wherein the passageway has an upper portion and a lower, smaller diameter portion, the intersection of which forms a shoulder, and wherein the grommet has a larger diameter head portion and a smaller diameter tail portion, such that the head portion of the grommet seats upon the shoulder of the passageway.

6. The dispensing closure as described in claim 1, further comprising a cap detachably mounted to the dispensing end of the dispensing spout.

7. The dispensing closure as described in claim 1, and further comprising a plurality of vent openings in an annular configuration around the base of the housing outside the perimeter of the dispensing spout.

8. The dispensing closure as described in claim 7, and further comprising an annular gasket seated within the housing such that the gasket sealingly covers the plurality of vent openings.

9. The dispensing closure as described in claim 8, wherein the annular gasket has a main portion and an inwardly protruding flap portion, such that the flap portion covers the vent opening.

10. A dispensing closure for selectively dispensing fluid from a container into a receiving system, the dispensing closure comprising:

a housing having an inner threaded surface for threaded attachment to the container, and an outer surface, the housing being substantially cylindrical about a central vertical axis;

a dispensing spout extending downwards from the housing and having a dispensing end and a receiving end;

a plurality of pillars, integrally molded with, and extending upwards from, the upper end of the dispensing spout, the pillars having retaining tabs extending inwardly therefrom;

a circular aperture formed by an inwardly-extending flange on the dispensing end of the spout;

a valve assembly contained within the dispensing spout between the retaining tabs and the circular aperture, comprising a resilient, elastomeric stopper having a top end and a sealing end, the sealing end being sized to seat sealingly within the circular aperture of the dispensing spout; and a vent opening within the housing at a location displaced from the spout.

11. The dispensing closure as described in claim 10, wherein the vent opening comprises an opening in the housing forming a passageway to the inside of the closure, and a grommet anchored within the passageway for selectively closing the vent opening.

12. The dispensing closure as described in claim 11, wherein the passageway has an upper portion and a lower, smaller diameter portion, the intersection of which forms a shoulder, and wherein the grommet has a larger diameter head portion and a smaller diameter tail portion, such that the head portion of the grommet seats upon the shoulder of the passageway.

13. The dispensing closure as described in claim 12, further comprising a cap detachably mounted to the dispensing end of the dispensing spout.

14. The dispensing closure as described in claim 10, wherein the dispensing spout is integrally molded within the housing, and wherein the vent is formed within the housing at a location displaced apart from the dispensing spout.

15. A dispensing closure for selectively dispensing fluid from a container into a receiving system, the dispensing closure comprising:

a housing having an inner threaded surface for threaded attachment to the container, and a base surface, the housing being substantially cylindrical about a central vertical axis;

a dispensing spout extending downwards from the base of the housing, the spout having a dispensing end and a receiving end;

a plurality of pillars, integrally molded with, and extending upwards from, the upper end of the dispensing spout, the pillars having retaining tabs extending inwardly therefrom;

a circular aperture formed by an inwardly-extending flange on the dispensing end of the spout;

a valve assembly contained within the dispensing spout between the retaining tabs and the circular aperture, comprising a resilient, elastomeric stopper having a top end and a sealing end, the sealing end being sized to seat sealingly within the circular aperture of the dispensing spout;

a plurality of vent openings within the housing, and placed in an annular configuration outside the perimeter of the spout; and an annular gasket seated within the base surface of the housing such that the gasket sealingly covers the vent openings.

16. The dispensing closure as described in claim 15, wherein the annular gasket has a main portion and an inwardly protruding flap portion, and wherein the flap portion covers the vent openings, while the main portion rests within an annular channel within the base surface of the housing.

* * * * *